United States Patent [19]

Granek et al.

[11] 4,058,167

[45] Nov. 15, 1977

[54] FIRE PROTECTION APPARATUS

[75] Inventors: Gerhard Granek, Downsview; Clifford Paul Robert Greenan, Unionville, both of Canada

[73] Assignee: Clifford Paul Robert Greenan, Unionville, Canada

[21] Appl. No.: 704,821

[22] Filed: July 13, 1976

[51] Int. Cl.[2] ..... A62C 37/18

[52] U.S. Cl. ..... 169/61; 169/17; 239/450

[58] Field of Search ..... 169/60, 5, 61, 16, 17; 239/450, 209

[56] References Cited

U.S. PATENT DOCUMENTS

| | | | |
|---|---|---|---|
| 792,794 | 6/1905 | Rogers | 169/16 |
| 1,692,052 | 11/1928 | Perkins | 169/5 |
| 2,667,383 | 1/1954 | Hensel | 239/450 X |
| 2,865,674 | 12/1958 | Jelmeland | 169/5 |
| 3,016,956 | 1/1962 | Olandt | 169/11 |
| 3,865,192 | 2/1975 | Dunphy | 169/61 |

*Primary Examiner*—John J. Love
*Attorney, Agent, or Firm*—Ridout & Maybee

[57] ABSTRACT

Fire protection apparatus having a conduit formed internally with longitudinally continuous compartments for conveying water or fire-extinguishing gas or foam, and spray nozzles spaced along the conduit and each connected to a different compartment thereof. Combustion detectors are arranged in each of the areas adjacent to the conduit which are covered by the spray from the nozzles and operate a control system selectively supplying fluid to a compartment of the conduit when a fire hazard is detected, so as to supply the particular nozzle or nozzles covering the area where the fire hazard has arisen. An extensive network of piping is avoided and the apparatus can be installed inconspicuously and without the need for robust jointing, sealing and supporting fittings.

8 Claims, 8 Drawing Figures

11
43
46

11
43
44

19
34
18
32
11
31
29
33
33
14
17
34
27
28
14
30
34
22

17
20
18b
18a
18c
18d
26
21
24
23

FIRE PROTECTION APPARATUS

BACKGROUND OF THE INVENTION

1. Field of the Invention

This invention relates to fire protection apparatus and more particularly to apparatus for installation in a building and intended for distributing fire-extinguishing fluid selectively from a central source thereof to the areas where a fire hazard has arisen. The apparatus of the invention is more especially advantageous, although not exclusively so, when applied to fire-protection in small or medium-sized premises such as residential apartments and office premises.

2. Description of the Prior Art

The form of fire-protection system most commonly met with is the conventional sprinkler system, having an extensive network of piping permanently filled with water and being equipped with heat-fusible water-releasing and sprinkling devices.

However, quite commonly in existing premises the sprinkler system extends only to the common access areas of the building such as the corridors and staircases, leaving private areas such as private residential apartments or office premises within the building unprotected, and in many buildings, particularly older premises, there is no sprinkler system at all.

Systems following the principles of the known sprinkler system often cannot be conveniently installed in existing premises or private areas thereof because of the difficulties and cost involved in installing the extensive lengths of piping required, and the need for providing elaborate supporting structure for carrying the weight of the water-filled piping. Furthermore, the obtrusiveness of the exposed piping and its sprinkling devices is somewhat undesirable, and concealment of the system above overhead panelling or by embedding it in the material of the ceiling may be unacceptable or impractical.

SUMMARY OF THE INVENTION

In the present invention, the fire protection apparatus comprises one or more conduits each divided into a plurality of longitudinally continuous compartments, along which water or other fire-extinguishing fluid can be conveyed. For applying the fluid to the area or areas where a fire danger is present, there is provided a plurality of nozzles covering different areas to be protected, each connected to a different compartment of the conduit. Smoke detectors, heat detectors, or other forms of fire hazard detectors are arranged in or adjacent the areas covered by the nozzles, and these serve to control the operation of means which selectively supply fluid to a compartment or compartments of the conduit so as to direct the fluid to nozzles covering the areas where heat or smoke is detected.

This system has the advantage that a single conduit having the nozzles at spaced regions along its length can serve to offer fire-protection to a number of rooms or other areas within premises where the apparatus is installed, while the nozzles themselves need not be positioned centrally over the rooms to be protected. The conduit may be installed unobtrusively in the fashion of cornicing along the upper edges of the walls of the premises, and will extend from a central source of the fire-extinguishing fluid and through the various areas to be protected, with the nozzles being directed towards the interior of the rooms or other areas and with the smoke, heat, or other fire hazard detectors being arranged centrally within the rooms. As the conduit is not permanently filled or pressurized, relatively lightweight and simple jointing arrangements and supporting fittings can be used. In a preferred embodiment, the conduit is of rectangular external profile and can thus be readily and inconspicuously received in the angle between the ceiling and the wall of the room.

BRIEF DESCRIPTION OF THE DRAWINGS

The invention will now be more fully described, by way of example only, with reference to the accompanying drawings in which.

DESCRIPTION OF THE PREFERRED EMBODIMENTS

The drawings illustrate a fire protection system installed in a typical two bedroom residential apartment.

Figure 1:
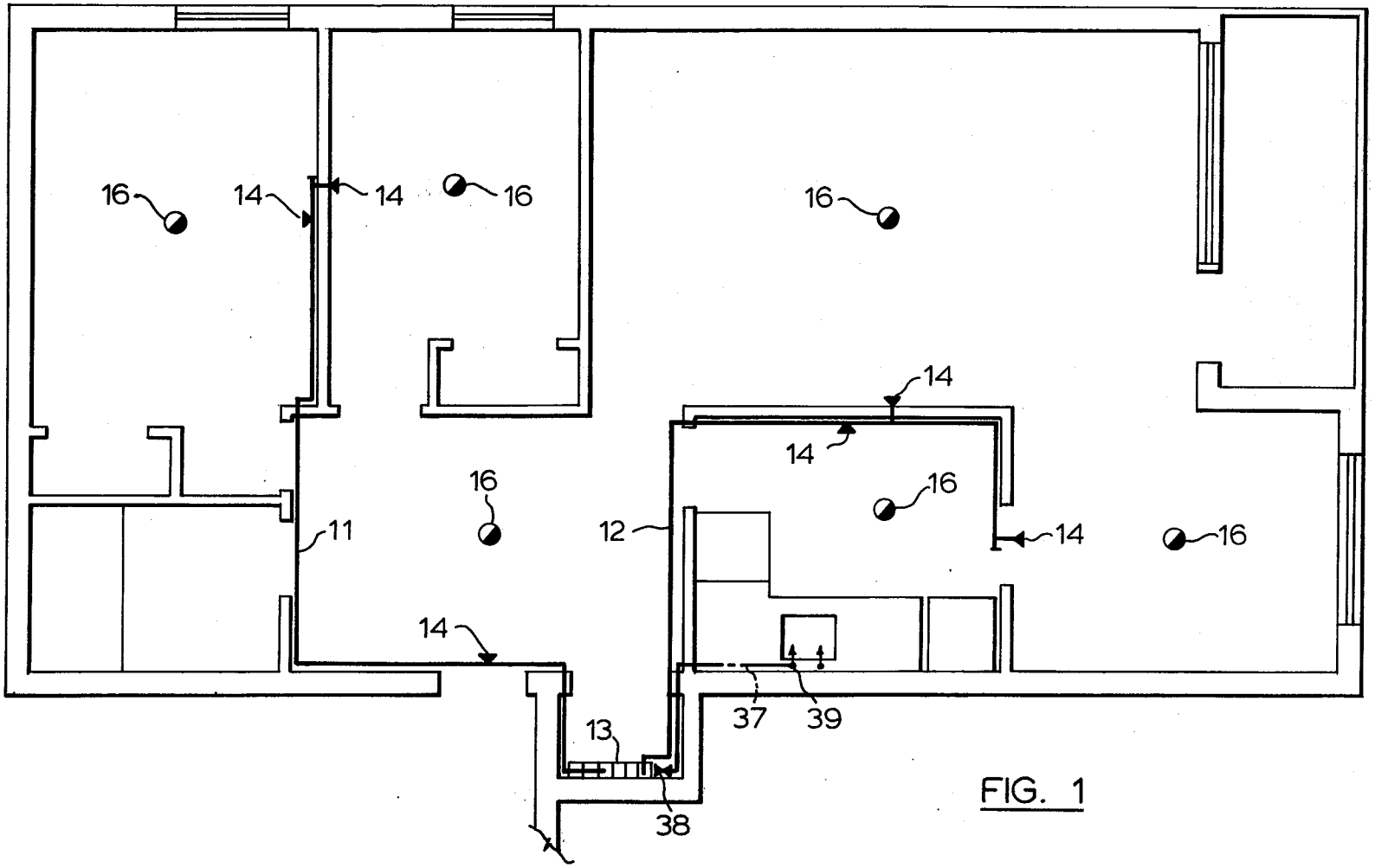
FIG. 1 shows a plan of an apartment having the apparatus of the invention installed.

As shown in FIG 1, the apparatus comprises two lengths of multi-compartmental conduit 11 and 12, which extend from a common water-supply manifold 13 horizontally through the rooms of the apartment. Nozzles 14 are connected at intervals along the conduit, these nozzles each being directed into the interior of a different respective area or room of the apartment.

Associated with each nozzle 14 there is a fire hazard detector 16, which is arranged centrally in the room or area toward which the nozzle 14 is directed.

Figures 2, 2A, 6, 7:
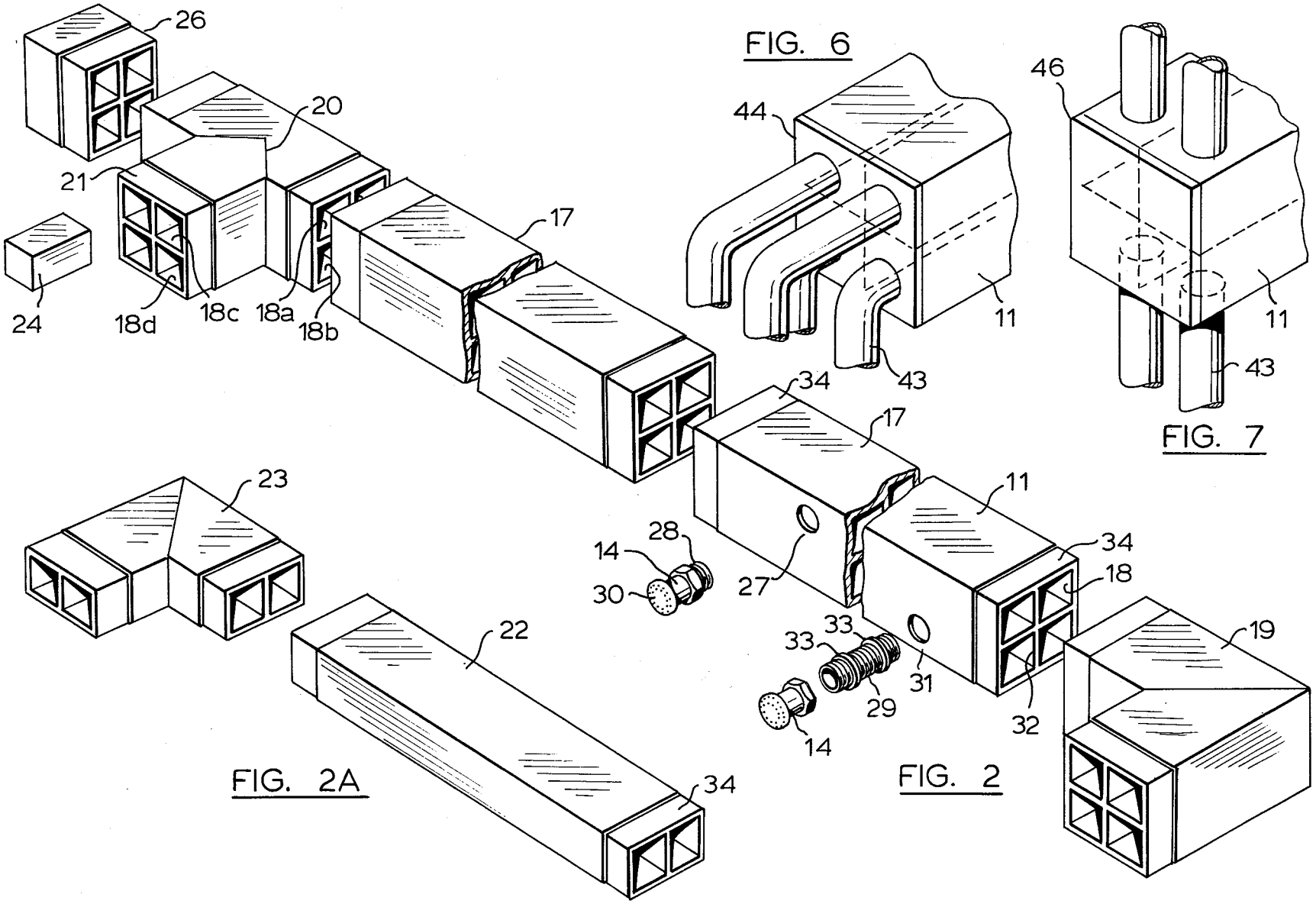
FIG. 2 shows a perspective partly fragmentary view of a four compartment conduit employed in the apparatus of the invention.
FIG. 2A shows an alternative embodiment having two compartments.
FIGS. 6 and 7 show respectively alternative forms of connection between the manifold and the conduit.

Referring to FIG. 2, this shows the construction of the conduit in greater detail. The conduit comprises adjoining sections 17, each of which in the form shown in the drawings has four longitudinally continuous internal compartments 18. The individual sections 17 can be manufactured by any one of a number of alternative manufacturing techniques, for example by inserting appropriate internal longitudinally-extending partitioning within a tubular conduit in leak-tight fashion, or by uniting together in side-by-side relationship a plurality of individual tubes to form a composite multi-compartmented structure. However, in the most advantageous form, each section of the conduit 17 is a unitary extrusion having longitudinally extending internal passageways formed using an extrusion die equipped with an appropriately configured spider or multiple mandrel which provides the extrusion internally with the desired continuous voids. In the preferred form, the conduit is formed of aluminum, but it will be appreciated that other metals may be employed, and that the conduit may be formed of plastics materials. By way of example it may be mentioned that the external dimensions of the conduit may suitably be approximately 2 inches on each side, each compartment 18 being approximately one inch square.

The conduit may include angled corner pieces as illustrated at 19 in FIG. 2 formed by mitre jointing two sections of the conduit together. Branches or tee junctions can also be formed through appropriate jointing of sections of the conduit along inclining faces, as illustrated at 20 in FIG. 2, giving communication between two of the compartments 18*a* and 18*b* with corresponding compartments 18*c* and 18*d* of the side branch 21.

In FIG. 2A there is shown a two compartment conduit, which can be manufactured in a manner similar to that used for the four compartment conduit. The two compartment conduit may likewise comprise individual sections 22 which can be joined together end to end, and can include mitre joined cornerpiece 23.

At the ends of the conduit, the compartments 18 are closed by individual plugs 24 fitting into the compartments, or by the addition of a closed ended end cap 26.

The nozzles 14, which are noted above are each connected into a different compartment of the conduit, are fitted into apertures 27 formed through the exterior walls of the conduit 11 and are provided with a screw fitting 28 or other arrangement giving a leakproof seal between the body of the nozzle 14 and the wall of the conduit 11. Each nozzle 14 is formed with an array of fine outlet holes 30, so as to deliver a fine water spray to the interior of the adjacent area.

As can be seen from FIG. 1, the conduits 11 and 12 are mounted flush with the walls of the building, and will normally be supported at the upper edge of the walls. The rectangular external profile of the conduits permits them to be fitted snugly in the angle between the wall and the ceiling. Conventional clips and brackets are employed to affix the conduits 11 and 12 to the walls. Relatively lightweight fixing devices can be employed, since the conduits are normally completely empty and the fixing devices are therefore not continuously under load.

Where a connection is to be made to a compartment 18 of the conduit lying directly adjacent the wall of the building, the connection can conveniently be made through an extension tube 29 which is passed through an aperture 31 in the exterior of the conduit, and through a corresponding aligned aperture in the partition wall 32 within the conduit 11. The tube 29 is sealed in leak-tight fashion to the exterior wall of the conduit and to the internal wall 32 by resilient sealing washers 33 fitted over the tube 29.

Figure 3:
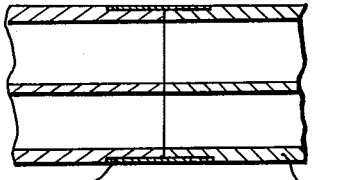
FIGS. 3 and 4 show longitudinal sections through the conduit, illustrating alternative forms of jointing between sections of the conduit, respectively.
Figure 4:
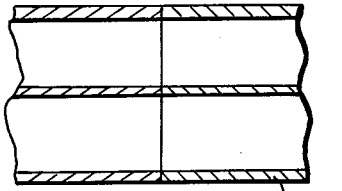

FIGS. 3 and 4 show arrangements for joining together the ends of the sections of the conduit 11. In the preferred form, as shown in FIGS. 2, 2A and 3, each end of each section is rabbeted as shown at 34, and the aligned ends of the adjoining sections are secured together in a leak-tight joint by applying adhesive tape 36 around the rabbeted portions. Caulking material can be applied on the end surfaces of the sections before bringing the ends together. Alternatively, as shown in FIG. 4, the sections of the conduit 11 may be butt-jointed and secured together with a film of adhesive applied on the end surfaces of the conduit sections. Since the compartments 18 of the conduit are normally empty and not under pressure, it is merely necessary to achieve a strength of joint capable of withstanding the relatively low back pressure that results for the period that fluid is supplied to the nozzles 14.

Figure 5:
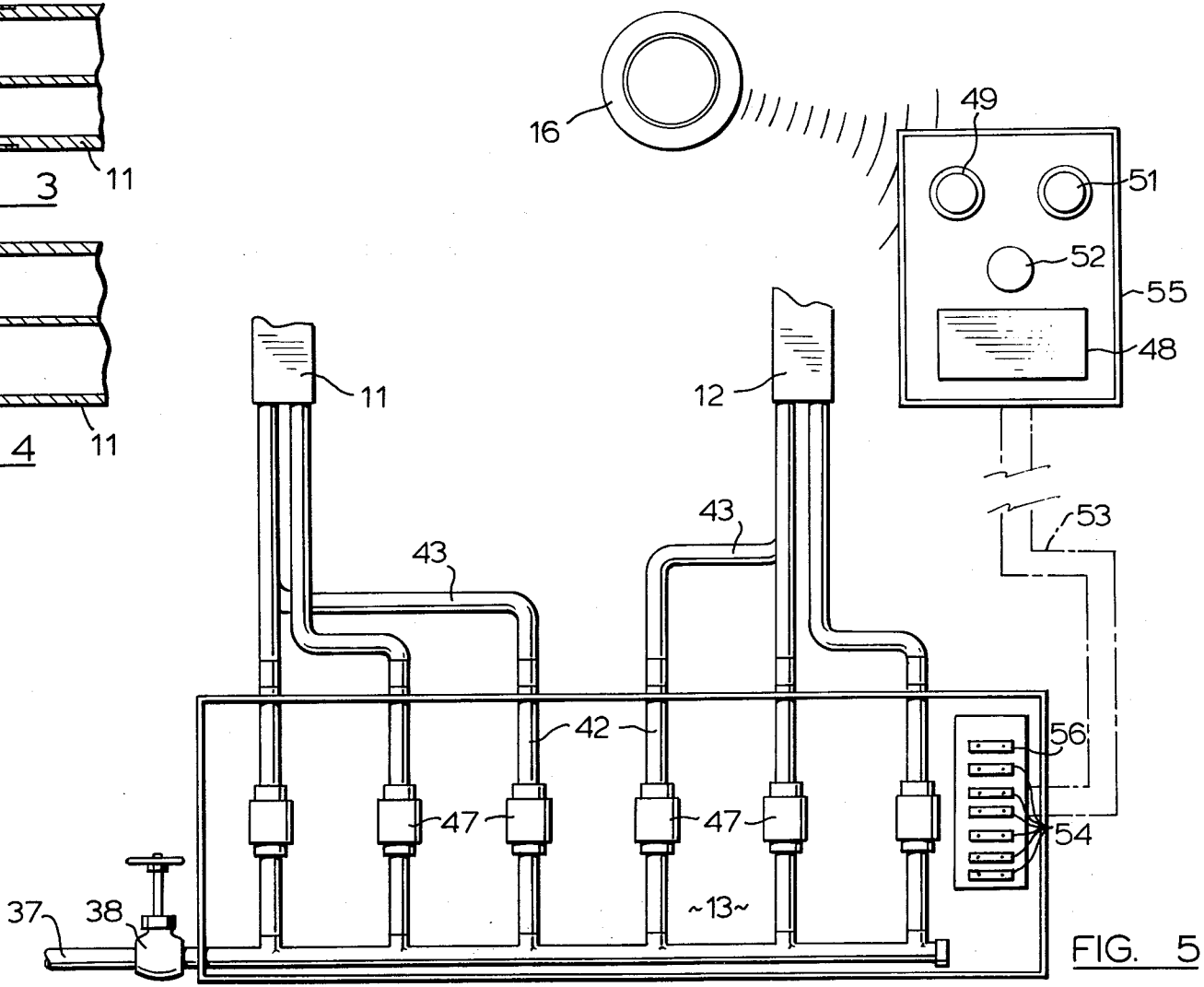
FIG. 5 is a side view of the valving and supply manifold of the apparatus.

FIG. 5 shows the manifold arrangement 13 which supplies fire extinguishing fluid selectively to the individual compartments 18 of the conduits 11 and 12. In the present instance, water is used as the fire extinguishing fluid and is supplied through a main supply pipe 37 equipped with a manually operable stopcock 38 and connected to an adjacent cold water main supply 39, for example the cold water supply to a faucet in the kitchen of the apartment. The manifold 13 is equipped with six outlets 42 each connected through piping 43 to a respective compartment 18 of the conduits 11 and 12, thus connecting each of the six nozzles 14 to a separate outlet 42. FIG. 6 shows one form of connection between the conduit 11 and the pipes 43, wherein the end of the conduit 11 is sealed off with a closure plate 44 having apertures to which the pipes 43 are connected. FIG. 7 shows an alternative form in which the conduit 11 is closed at its end by a closure plate 46, and the pipes 43 enter through apertures formed in the side walls of the conduit 11.

As shown in FIG. 5, each of the manifold outlets is equipped with an on-off valve 47. These valves 47 are electrically operated, and can be conventional solenoid-operated valves. Each of the valves is operatively linked through a control system to a respective fire hazard detector 16, so that when a detector 16 is activated through detection of flame, heat, smoke or other combustion product, the particular solenoid valve 47 operatively linked thereto is opened to allow flow of water selectively to the compartment 18 of the conduit which communicates with the respective nozzle 14 associated with the detector 16 which has been activated.

As the detectors 16 there may be employed any conventional form of fire hazard detector such as a photoelectric or thermoelectric flame or heat detector or an ionization chamber type of combustion products detector. Each detector 16 includes a transmitter which emits a distinctive and individually encoded signal when the detector is activated. The control system, as shown schematically in FIG. 5, includes a control panel 47 located adjacent the manifold 13 and including a signal receiver and decoder 48, which is responsive to the signals emitted by the detectors 16, a pilot light 55 which is illuminated when the control system is connected to a source of electrical power and indicates that the control system is operational, a warning light 51 which becomes illuminated when a signal is received by the receiver and decoder 48, and a pushbutton switch 52, which when pressed deactuates the control system. The warning light 51 may be connected to an audible warning device e.g. a buzzer or bell which sounds an audible alarm when a signal is received from a detector 16. The receiver and decoder 48 is connected electrically as indicated at 53 to a plurality of relays 54 each connected to a respective valve 47, and a timing device 56 is connected in common to the relays 54, and serves to prevent the relays 54 from actuating the valves 47 until a predetermined period of time, e.g. of the order of thirty seconds, has elapsed.

The details of suitable transmitter-receiver and decoder arrangements and of the electrical circuitry associated with the warning lights 49 and 51, the relays 54, timer 56 and push-button deactuating switch 52 will be readily understood by those familiar with the techniques of electronic remote control. Merely by way of example, it may be mentioned that the signal emitted by each transmitter of the detectors 16 may be individually distinguished and encoded through each transmitter emitting a different frequency ultrasonic or radio frequency signal, or each transmitter can operate on the same frequency but emits a signal which is individually encoded through amplitude or pulse modulation e.g. pulse code modulation, pulse width modulation, or pulse frequency modulation.

In operation, when a signal is received from a detector 16, the receiver and decoder 48 generates an output current which is fed to the individual relay 54 which is connected to the valve 47 controlling the water flow to the respective nozzle 14 associated with the detector 16 which has been activated. At the same time, the warning light 51 is illuminated, and any audible warning alarm activated, so as to give a warning of the fire hazard, and the timer 56 is started. When the predetermined period of time as measured by the timer has elapsed, the output from the relays 54 becomes electrically connected with the solenoid valves 47, so that the valve 47 connected with an actuated relay 54 becomes opened, thus selectively allowing flow of water to the nozzle 14 which will direct water to the area where a fire hazard has arisen. The relay 54 can be deactuated by depressing the push button switch 52, thus closing the solenoid valves 47 and interrupting the water flow. The operation of the timer 56 allows for a predetermined delay between the activation of a detector 16 and the commencement of the water flow, thus giving an opportunity for deactivating the control system by pressing the pushbutton 52 when a detector 16 is activated for test purposes or becomes activated accidentally.

It will be understood that the form of the invention herewith shown and described is a preferred example, and that various modifications can be carried out without departing from the spirit of the invention or the scope of the appended claims. Thus, for example, instead of using water as the fire extinguishing fluid, the above described control system may instead serve to direct a flow of a fire extinguishing gas, e.g. carbon dioxide, or other conventional fire extinguishing fluid e.g. a foam to the area of the fire hazard. Instead of employing the valves 47 connecting the compartments of the conduits 11 and 12 to a common source of the fire extinguishing fluid, there can be employed a plurality of fire extinguishing fluid sources, for example foam generators, which are activated under control of the relays 54.

What we claim as our invention is:

1. Fire protection apparatus comprising a conduit providing a plurality of internal longitudinally continuous compartments and having spaced at intervals along its length a plurality of fluid directing nozzles each connected to a respective compartment of the conduit, said nozzles being arranged to direct fluid to different respective localised areas adjacent the conduit, a plurality of fire hazard detectors, one detector being associated with each of said areas, and means for supplying fire-extinguishing fluid selectively to the compartments of the conduit, said means so operating under the control of the detectors as to supply the fluid to the compartment and nozzle connected thereto which directs the fluid to the area where a fire hazard is detected.

2. Apparatus as claimed in claim 1 wherein said conduit extends along the upper edge of an interior wall of a building.

3. Apparatus as claimed in claim 1 wherein said conduit is of rectangular external profile.

4. Apparatus as claimed in claim 3 wherein said conduit comprises a unitary extrusion having longitudinally extending internal passageways.

5. Apparatus as claimed in claim 4 wherein said supplying means comprise a plurality of independently operating valves connected to said conduit.

6. Apparatus as claimed in claim 5 wherein said valves are connected between said conduit and a manifold adapted to be connected to a fluid source.

7. An apparatus as claimed in claim 1 wherein said nozzles deliver a fine water spray.

8. Apparatus as claimed in claim 1 wherein the conduit passes horizontally through a plurality of rooms in a building and is supported on the surfaces of walls of the rooms, a plurality of the rooms each having at least one nozzle therein.

* * * * *